United States Patent [19]

Timuska et al.

[11] Patent Number: 4,761,124

[45] Date of Patent: Aug. 2, 1988

[54] SCREW-TYPE ROTARY MACHINE HAVING AT LEAST ONE ROTOR MADE OF A PLASTICS MATERIAL

[75] Inventors: Karlis Timuska, Spånga; Ulf Sjölin, Stockholm, both of Sweden

[73] Assignee: Svenska Rotor Maskiner Aktiebolag, Stockholm, Sweden

[21] Appl. No.: 934,445

[22] PCT Filed: Mar. 13, 1986

[86] PCT No.: PCT/SE86/00109

§ 371 Date: Nov. 10, 1986

§ 102(e) Date: Nov. 10, 1986

[87] PCT Pub. No.: WO86/05555

PCT Pub. Date: Sep. 25, 1986

[30] Foreign Application Priority Data

Mar. 15, 1985 [SE] Sweden ..... 8501280

[51] Int. Cl.[4] ..... F03C 2/08; F04C 18/16

[52] U.S. Cl. ..... 418/153; 418/201

[58] Field of Search ..... 418/152, 153, 156, 201

[56] References Cited

U.S. PATENT DOCUMENTS

| | | | |
|---|---|---|---|
| 2,868,442 | 1/1959 | Nilsson | 418/152 |
| 3,015,283 | 1/1962 | Knipp | 418/15 |
| 4,490,102 | 12/1984 | Carré et al. | 418/178 |

FOREIGN PATENT DOCUMENTS

| | | | |
|---|---|---|---|
| 2409554 | 9/1975 | Fed. Rep. of Germany | 418/152 |
| 7001312 | 7/1970 | Netherlands | 418/201 |
| 578057 | 6/1946 | United Kingdom | 418/152 |

*Primary Examiner*—John J. Vrablik
*Assistant Examiner*—Leonard P. Walnoha
*Attorney, Agent, or Firm*—Frishauf, Holtz, Goodman & Woodward

[57] ABSTRACT

A screw compressor of the kind incorporating at least one male rotor and one female rotor, with helically extending lands and grooves. The female rotor (1) is injection moulded from a plastics material having a modulus of elasticity of at most 25,000 N/mm$^2$. The lands (3) of the female rotor have a thickness (a) which is so adapted to the modulus of elasticity of the plastics material as to allow the lands to be deflected resiliently when clashing with the other rotor (2), as a result of dimensional deviations of the order likely to occur during hardening or curing of the plastics material, or at prevailing temperature variations, but not as a result of the pressure exerted by the working fluid. Due to the injection moulding the surface smoothness is fine enough to make subsequent finishing unnecessary and damages caused by lack of machining are avoided because of the resilient deflecting of the lands of the female rotor when clashing with the other rotor.

3 Claims, 1 Drawing Sheet

SCREW-TYPE ROTARY MACHINE HAVING AT LEAST ONE ROTOR MADE OF A PLASTICS MATERIAL

Figure 1:
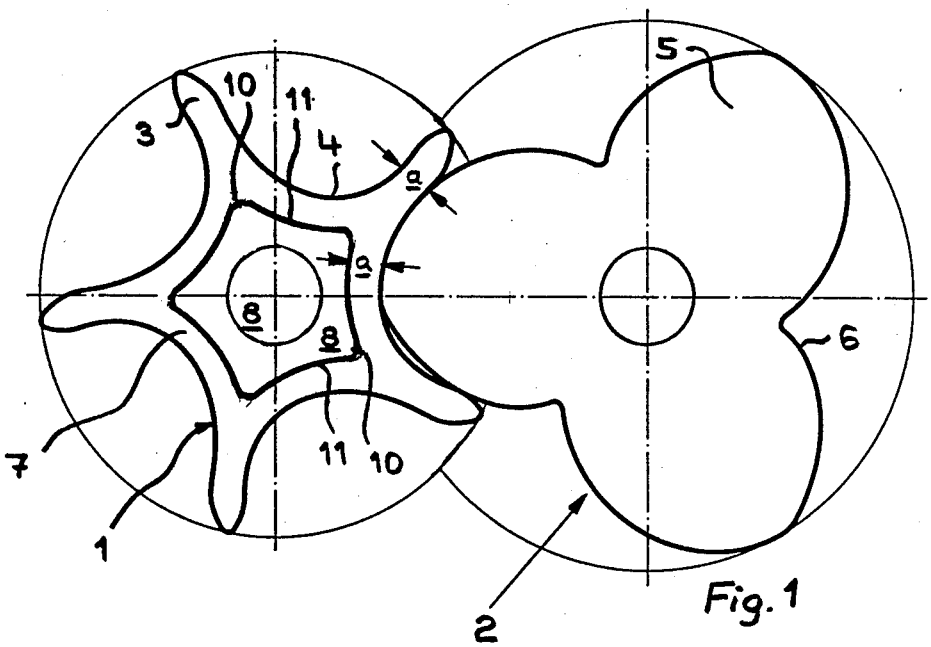

The present invention relates to a screw-type rotary machine intended for the compression or expansion of an elastic fluid and comprising at least two rotors, a male rotor and a female rotor, provided with helically extending lands and grooves, of which rotors at least one is comprised substantially of a plastics material located preferably on a metal shaft or core.

Screw rotors are normally manufactured by machine cutting solid metal blanks. The screw rotors have a complicated geometric form, which demands a high degree of accuracy in manufacture. In addition, the amount of material cut-away during manufacture is very considerable. In combination, these drawbacks result in long manufacturing times and high costs.

Consequently, it has long been desired to produce the rotors of such machines in a simpler fashion and with less stringent requirements on precision and accuracy, in order to enable the rotors to be manufactured in very large quantities at reasonable costs.

Endeavours have been made as early as in 1953 to produce the rotors from plastics, as evident from the U.S. Pat. No. 2,868,442. Because of the limited strength properties of plastics materials, however, it has been necessary to manufacture the female rotor from metal, since the lands of the female rotor are relatively narrow, and to utilize the advantageous elastic properties of plastics in the male rotor, which remains shape stable even when made predominantly from plastic. It is necessary to machine the plastic rotor finely and with precision, however, in order to obtain the desired accuracy in shape and configuration, and this has been the case also in connection with attempts to produce moulded female rotors from plastics. An unavoidable complication is, however, that the rotor during the solidification process is subjected to a dimensional deviation.

Due to the fact that a dismountable mould is impossible to use here, it would be thinkable to screw the solidified rotor out of an integral mould after removal of a removable end-wall of the mould. This method is not applicable without problems, however, because the rotor becomes firmly jammed in the mould due to the dimensional deviation occurring during the solidification process.

Another substitute for metal in the present context are the ceramic materials, as disclosed in the German Patent Specification Serial No. 1,426,771, which when taken in combination with a plastics male rotor in accordance with the aforesaid U.S. patent, can afford some improvement.

As will be seen from U.K. Patent Specification Serial No. 1,276,348, endeavours have been made to coat or line steel rotors with a plastics material, in order to protect the rotors against corrosion. Although plastics materials have a certain degree of elasticity or resiliency, they are sufficiently hard to resist deformation as a result of the pressure exerted by the working medium. This solution affords a certain amount of improvement with regard to function, but does nothing to alleviate the complicated manufacturing procedures required, or to lessen the time taken to effect these procedures. In addition it is difficult to achieve satisfactory bonding of the plastics coating or lining to the steel substrate.

The object of the present invention is therefore to provide a screw-type rotor machine of the aforesaid kind, with which the rotors thereof can be manufactured quickly and cheaply, in a manner which enables the rotors to be produced in large number at a low labour input. This object has been achieved in accordance with the invention in that the rotor which is made at least predominantly of a plastics material is the female rotor, which is injection moulded from a plastics material having a modulus of elasticity of at most 25,000 $N/mm^2$, and in that the thickness of the lands of the female rotor is so adapted in respect of said modulus of elasticity that the lands are able to spring away, be deflected resiliently, when clashing contact occurs with the other rotor, as a result of dimensional deviations caused by hardening or solidification of the plastics material and the temperature variations to which it is subjected, but not solely as a result of the pressure exerted thereon by the working fluid.

The invention is thus based on the concept that not all clashing contact or unintended contact which can occur as a result of minor deviations from the profile intended, and which hitherto has normally led to damaged rotors, shall be avoided whatever the cost, but that such contact shall be permitted while preventing damage to the rotor/lands, by providing lands which yield or deflect resiliently to such contact, to a given extent, i.e. lands which are not shape-stable, this being in complete contradistinction to prevailing views on the construction of the female rotor. Because the rotor is injection moulded, the surfaces obtained are sufficiently smooth to obviate the need for subsequent machining, which is one prerequisite of a successful solution to the aforementioned problem.

A number of oil-injected screw compressors, each having an aluminum male rotor of simple manufacture and a plastics female rotor produced in accordance with the invention exhibited but a very small amount of play and were driven over long periods of time, including many start-stop sequencies, with no damage problems relating to the rotors whatsoever.

Further characteristic features of the present invention are set forth in the following claims.

Figure 2:
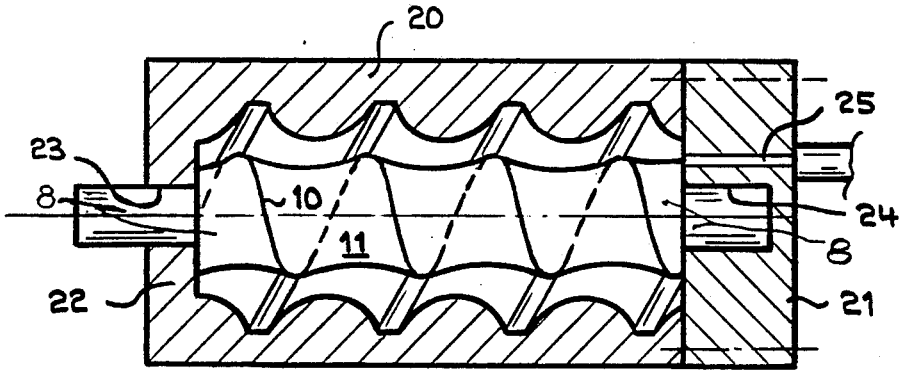

The invention will now be described in more detail with reference to the accompanying drawing, in which FIG. 1 illustrates one exemplifying embodiment of the profiles of a rotor pair intended for use in a machine according to the invention; and FIG. 2 is a longitudinal sectional view of a mould intended for the manufacture of the female rotor illustrated in FIG. 1.

FIG. 1 is an end view of a female rotor 1 and a male rotor 2. The female rotor 1 has helically extending lands 3 and intermediate grooves 4, and the male rotor 2 has helically extending lands 5 and grooves 6. The female rotor 1 comprises a plastics part 7 which is moulded on a steel shaft 8, by an injection moulding process utilizing the mould illustrated in FIG. 2.

The male rotor 2 may be made of aluminum or steel in a conventional manner, or of extruded aluminum or plastics.

The shaft 8 of the female rotor may have a circular cross-section, but since manufacture is effected by moulding the plastics directly onto the shaft, the plastics is preferably distributed as uniformly as possible around the periphery of the shaft, i.e. constant thickness, in order to ensure a uniform hardening or solidifying process in the absence of irregular dimensional changes.

Because of this, the shaft 8 has been milled-out slightly, so as to form helical edges or lands 10 at the base of each land 3 and concave surfaces 11 which extend parallel with the grooves 4 at a distance a therefrom, this distance being substantially equal to the mean thickness a of the lands 3.

As will be seen, the lands 3 are thinner than is normal for steel rotors, and the thickness of said lands is carefully calculated so as to afford, in combination with the modulus of elasticity of the plastics material, the aforesaid resilient deflection of the lands by an amount corresponding to such profile-deviations from a perfectly true profile as those which are liable to occur as a result of changes in the moulded shape of the plastics material while hardening or solidifying, or as a result of prevailing changes in temperature.

The modulus of elasticity can be placed at a level sufficiently low to provide a certain degree of surface elasticity, in a known manner, but not so low as to result in deformation due to the pressure exerted by the working fluid.

FIG. 2 illustrates schematically a mould 20 which is closed at one end and incorporates an inner wall which is profiled to correspond to the profile of the desired female rotor 1. The mould 20 includes a removable end-wall 21. The closed end 22 of the mould 20 has located centrally therein an aperture 23, and the removable end-wall 21 has a similar central aperture 24. The apertures 23 and 24 are each adapted to accommodate a shaft 8 having formed thereon the helical edges or lands 10 illustrated in FIG. 1, said shaft being placed in the mould prior to fitting the removable end-wall 21. The requisite amount of plastizied plastics material is injected into the mould through one or more injection holes 25, the plastics material preferably comprising a thermosetting resin incorporating millimeter long reinforcing fibres, e.g. glass fibres, and having a modulus of elasticity not higher than 8000 $N/mm^2$. The plastics material fills the cavity between the shaft 8 and the internal surfaces of the mould, during which process air present in the mould is forced therefrom through air vents not shown. Subsequent to hardening of the plastics material, while suitably cooling the mould 20, the end-wall 21 can be removed and the finished rotor, together with the shaft 8, screwed out of the mould 2, in a corresponding manner to that described and illustrated in our Swedish Patent Specification Serial No. 217 570.

This is practicable without damage to the rotor due to the fact that the resiliently yielding lands and thus the rotor itself do not get jammed in the mould. It has turned out, as a matter of fact, that a heavy compression occurs in the longitudinal direction of the lands during the solidification of the rotor in the mould.

Measuring of the female rotor 1 manufactured in this way shows that the shape of the rotor deviates from the intended shape mainly in that the lands 3 under the influence of the solidification of the plastics have lengthened somewhat giving rise to a changed pitch of the lands 3 at the end portions of same. The deviation measured perpendicular to the surfaces of the lands just beneath the top radius may amount to round 0.1 mm for a rotor having a diameter of 50 mm.

It is this type of deviation that in previous plastic rotor experiments was eliminated by a subsequent machining of the profile resulting in more thin-walled lands than intended and, consequently, rotor clearances influenced in negative direction. These drawbacks combined with the costs for a subsequent machining have resulted in the fact that, in spite of experiments initiated 25 years ago, screw rotor machines equipped with rotors made of plastics not yet have been introduced into the market. A solution of the defined problem has been obtained by realizing the possibility of designing the female rotor in accordance with the invention such that a sufficient yielding of the lands is achieved, and tests for more than one year under normal operating conditions have verified that it is possible now to manufacture screw rotor machines with as well as without synchronizing gears in an uncomplicated and inexpensive way without subsequent machining of the profile produced by moulding the rotors from a plastics material.

We claim:

1. A screw-type rotor machine for the compression or expansion of an elastic fluid, wherein a working fluid exerts a certain pressure on lands of rotor members in the machine, comprising:

a male rotor and a female rotor, each including helically extending lands and grooves formed between adjacent ones of said lands, wherein the female rotor comprises a metal core shaft and a plastics material having a modulus of elasticity of at most 25,000 $N/mm^2$ which material is injection molded over said core shaft, and the lands of the female rotor have a mean thickness corresponding to the modulus of elasticity of said plastics material so that the lands of the female rotor can deflect resiliently when operatively engaging the lands of said male rotor, but the lands of said female rotor do not deflect significantly solely as a result of the pressure exerted on said lands by the working fluid, said core shaft including helically extending lands formed to project into the bases of the female rotor land;

and wherein said core shaft has concave surfaces formed between adjacent ones of the lands on the core shaft, so that said concave surfaces are spaced form the surface of the grooves formed in the molded plastics material of the female rotor by a distance substantially equal to the mean thickness of the rotor lands.

2. A screw-type rotor machine according to claim 1, wherein the plastics material is a thermosetting resin reinforced with extremely short fibres of a suitable material.

3. A screw-type rotor machine according to claim 1, wherein the modulus of elasticity of the plastics material is also adapted so that local promontories in the profile of the female rotor in the order of some hundredths of a millimeter are flattened elastically when clashing with the male rotor.

* * * * *